United States Patent [19]

Jackson

[11] 4,319,596

[45] Mar. 16, 1982

[54] NAIL POLISH REMOVING DEVICE

[76] Inventor: Lonnie A. Jackson, P.O. Box 168, Bluff City, Tenn. 37618

[21] Appl. No.: 151,938

[22] Filed: May 21, 1980

[51] Int. Cl.[3] ..... A45D 29/05

[52] U.S. Cl. ..... 132/73.6; 132/75.6

[58] Field of Search ..... 132/73.5, 73.6, 74.5, 132/75, 75.6, 76.5

[56] References Cited

U.S. PATENT DOCUMENTS

| | | | |
|---|---|---|---|
| 2,877,810 | 3/1959 | Zackheim | 132/74.5 |
| 3,292,642 | 12/1966 | Vecchio | 132/73.6 |
| 3,563,252 | 2/1971 | Spohr | 132/73.6 |
| 3,754,556 | 8/1973 | Watkins | 132/73.6 |

FOREIGN PATENT DOCUMENTS

| | | | |
|---|---|---|---|
| 2263722 | 10/1975 | France | 132/73.6 |
| 526428 | 5/1955 | Italy | 132/73.6 |

*Primary Examiner*—Robert A. Hafer

[57] ABSTRACT

Disclosed is a nail polish removing device comprising a motor driven rotary brush or swab mounted in a substantially leakproof housing wherein the rotating swab comes into contact with a nail polish solvent, is wet by it, and rotates past one or a series of openings in the housing, each of which openings is normally substantially sealed by an openable diaphragm through which a finger can be inserted such that the fingernail is contacted in a wiping action by the solvent-wet rotating swab. The polish is very rapidly and thoroughly removed by this action without any attendant dripping of solvent or the like.

5 Claims, 4 Drawing Figures

NAIL POLISH REMOVING DEVICE

This invention relates to a nail polish removing device, and more particularly concerns a device for the use of manicurists or their customers for applying a polish removing fluid to the customers' nails individually or plurally, while at the same time subjecting the nails to a vigorous scrubbing action with the polish removing solvent whereby the polish is effectively removed therefrom and the nails are thoroughly cleaned.

Manicurists, in removing nail polish from patrons' fingers using the usual polish removing fluid, which may contain acetone or other suitable solvent, usually employ a swab, consisting of a wad of cotton, for applying the polish removing fluid to the nails individually, one at a time, while at the same time scrubbing the nails to remove the polish therefrom. This operation can be time-consuming and messy and requires the personal attention of the manicurist.

An object of this invention is to provide a device which essentially is automatic in operation for use by an untrained person for conveniently scrubbing the nails to remove the polish therefrom, in an equivalent manner that cotton swabs have been used heretofore, while at the same time avoiding harming furniture or the manicurist's own manicure, through inadvertently contacting the same with the polish removing solvent.

This and other objects hereinafter appearing have been attained in accordance with the present invention through the novel construction comprising a motor driven rotary brush or swab mounted in a substantially leakproof housing wherein the rotating swab comes into contact with a nail polish solvent, is wet by it, and rotates past one or a series of openings in the housing, each of which openings is normally substantially sealed by an openable diaphragm through which a finger can be inserted such that the fingernail is contacted in a wiping action by the solvent-wet rotating swab. The polish is very rapidly and thoroughly removed by this action without any attendant dripping of solvent or the like.

The construction and operation of the present device will be further clarified by the following description and drawing wherein FIG. 1 is a partially sectional, front view of the device;

Figure 1:
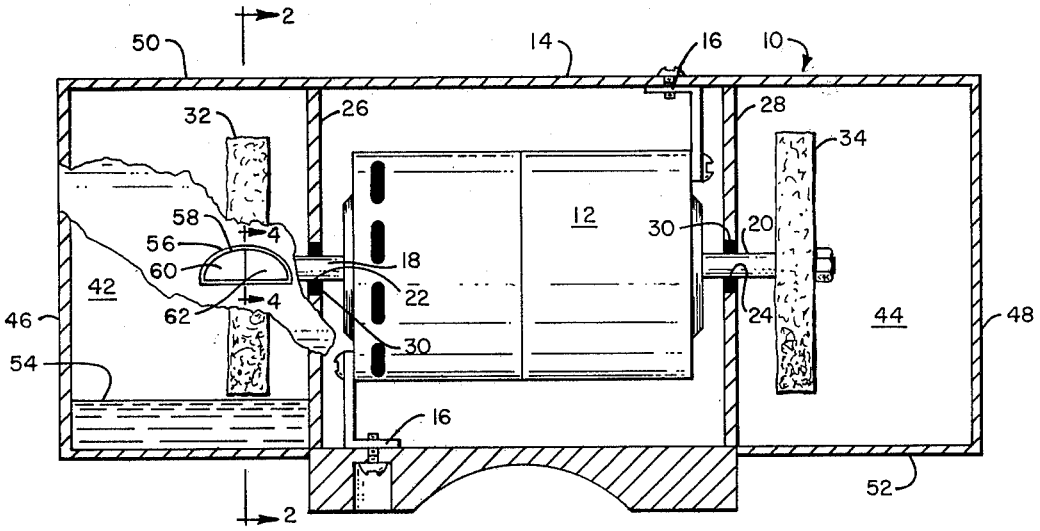

Referring to the drawing, the polish removing device 10, in the embodiment illustrated, comprises an electrical motor 12, preferably A.C. and adapted by suitable cord and plug to receive current, for example, from a conventional wall socket. The motor may be secured to a housing 14 by suitable means such as brackets 16, and may be provided with double output shafts 18 and 20 although a single shaft is all that is necessary to perform the principal function according to the present invention.

Figure 3:
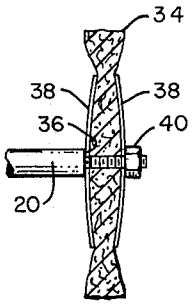
FIG. 3 is a sectional view of the rotary brush.

The motor shafts pass through holes 22 and 24 in walls 26 and 28 respectively, which holes are preferably provided with any convenient solvent resistant seal 30 made, for example, of Teflon, carbon on ceramic, or the like in known manner. To the shafts are attached circular brushes or swabs 32 and 34, preferably of wool type fabric in the form of a buffing wheel, although any reasonably absorbent fabric may be used and held in place, for example, by shoulders 36, washers 38, and nut 40, as shown in FIG. 3. The brushes may also be formed from bristles but, when so made, the bristles are typically immersed slightly in the solvent since they do not elongate as readily as the buffing type material under the influence of centrifugal force. These brushes are contained in their respective solvent-tight chambers 42 and 44 formed in any convenient manner from housing 14 and walls 26 and 28. These chambers are provided with suitable inlets and drains, e.g., threaded plugs to allow removal of solvent and draining and cleaning of the chambers. Any number of brushes and chambers may be provided, and one or more brushes may be used only for drying the nails. For ease of manufacture and assembly, end caps 46 and 48 may be removably sealed to the elongated end portions 50 and 52 of housing 14, thus allowing access to swabs 32 and 34 for assembly. Also, said end portions may be made sealingly attachable to the mid-portion of housing 14 and their respective walls 26 and 28.

Figure 4:
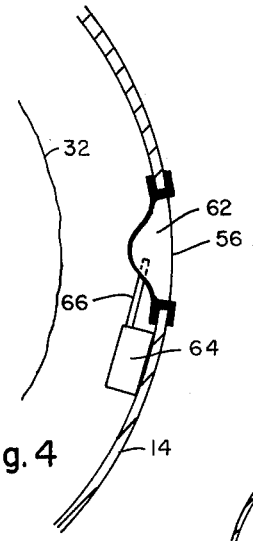
FIG. 4 is a sectional view of the finger opening and diaphragm of FIG. 1 taken along 4—4 thereof in the direction of the arrows, showing the diaphragm in its inwardly flexed position in contact with switch arm 66.
Figure 2:
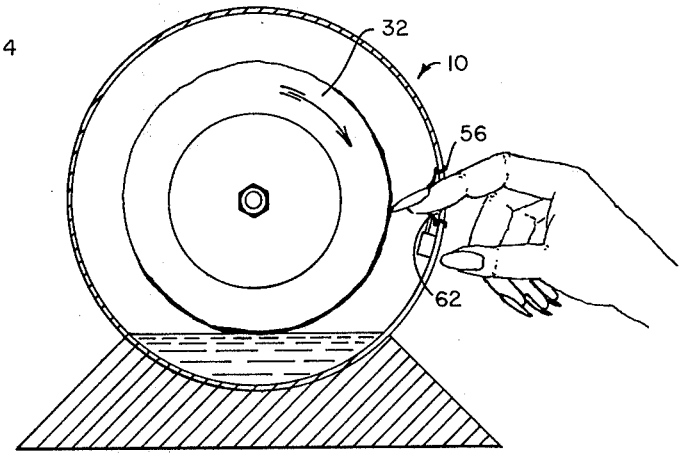
FIG. 2 is a sectional, end view in operation, of FIG. 1 taken along line 2—2 in the direction of the arrows.

As shown in the drawing, a nail polish remover, e.g., acetone or other such aliphatic ketone, is placed in at least one of chambers 42 and 44, preferably but not necessarily, to a level just below the swab as shown at 54 in FIG. 1. Rapid rotation of the swab, e.g., in the direction of the arrow in FIG. 2 causes the swab to extend its periphery by centrifugal action to just below the solvent level as shown in FIG. 2 and to become wet thereby. A port 56 is provided in the housing for allowing the end of a finger to be inserted into contact with swab 32. This port may be of any convenient size and shape and, preferably is provided with a sealing diaphram 58, one embodiment of which is shown enlarged in FIG. 4, comprising flexible rubber type flaps 60 and 62 which are secured along their edges to the housing and which are separated in the center as shown by the vertical center line. These flaps are made, for example, from acetone resistant elastomer, which can flex or stretch inwardly to allow insertion of the finger and which will re-assume their sealing position shown in FIG. 1 along the vertical center line when the finger is withdrawn. Any number of such flaps may be provided on the diaphragm and may have any convenient configuration. An electrical switch, normally open, such as a microswitch 64 may be connected in series with the motor power lead and secured by any suitable means to housing 14. The switch is provided with an arm 66 extending behind flap 62 and adapted to be contacted with the finger when inserted through port 56 to thereby close switch 64 and start the motor 12. Withdrawal of the finger reopens the switch and deenergizes the motor. This switch may be positioned in various locations, e.g., on the outside of the housing to achieve the desired results, the position requiring only that physical contact with arm 66 be made through the act of inserting the finger through port 56.

The invention has been described in detail with particular reference to preferred embodiments thereof, but it will be understood that variations and modifications can be effected within the spirit and scope of the invention.

I claim:

1. A nail polish removing device comprising motor driven rotary brush means mounted in a substantially leakproof housing, said housing having a nail polish solvent reservoir at its bottom, wherein said brush means rotates about a substantially horizontal axis, a portion of said brush means coming into contact with said nail polish solvent reservoir and being wet by it, the rotation of said brush means moving it past one or a series of openings in said housing, each of which openings is normally substantially sealed by openable diaphragm means through which a finger can be inserted such that the fingernail is contacted in a wiping action by said solvent-wet brush means.

2. The device of claim 1 wherein said diaphragm means comprises elastomeric flaps which normally substantially seal the opening.

3. The device of claim 1 wherein a plurality of brushes and corresponding openings are provided to allow for simultaneous, multiple fingernail cleaning.

4. The device of claim 1 wherein the brush is made of wool material in the form of a buffing wheel.

5. The device of claim 1 wherein an electrical switch in series with the motor power lead is positioned on said housing and is adapted to be actuated by insertion of the finger through said diaphragm means.

* * * * *